US011612206B2

(12) United States Patent
Kim et al.

(10) Patent No.: US 11,612,206 B2
(45) Date of Patent: Mar. 28, 2023

(54) DETACHABLE PAD FASTENING STRUCTURE OF HELMET AND HELMET INCLUDING SAME

(71) Applicant: KIDO SPORTS CO., LTD., Seoul (KR)

(72) Inventors: Dong Jong Kim, Incheon (KR); Dong Cheol Jeong, Hwaseong-si (KR)

(73) Assignee: KIDO SPORTS CO., LTD., Seoul (KR)

( * ) Notice: Subject to any disclaimer, the term of this patent is extended or adjusted under 35 U.S.C. 154(b) by 160 days.

(21) Appl. No.: 15/779,720

(22) PCT Filed: Mar. 21, 2016

(86) PCT No.: PCT/KR2016/002804

§ 371 (c)(1),
(2) Date: May 29, 2018

(87) PCT Pub. No.: WO2017/094974

PCT Pub. Date: Jun. 8, 2017

(65) Prior Publication Data

US 2020/0138142 A1 May 7, 2020

(30) Foreign Application Priority Data

Nov. 30, 2015 (KR) ..... 10-2015-0168948

(51) Int. Cl.
*A42B 3/12* (2006.01)
*A42B 3/10* (2006.01)

(52) U.S. Cl.
CPC ..... *A42B 3/127* (2013.01); *A42B 3/10* (2013.01); *A42B 3/12* (2013.01); *A42B 3/121* (2013.01);

(Continued)

(58) Field of Classification Search
CPC .. A42B 3/127; A42B 3/10; A42B 3/12; A42B 3/121; A42B 3/122; A42B 3/124; A42B 3/125

(Continued)

(56) References Cited

U.S. PATENT DOCUMENTS 2,863,151 A * 12/1958 Morgan, Jr. ..... A42B 3/127 2/414
4,282,610 A * 8/1981 Steigerwald ..... A42B 3/127 2/414

(Continued)

FOREIGN PATENT DOCUMENTS

EP 1854368 A2 11/2007
EP 2179669 A2 4/2010

(Continued)

OTHER PUBLICATIONS

Int'l Search Report dated Aug. 30, 2016 in Int'l Application No. PCT/KR2016/002804.

(Continued)

*Primary Examiner* — Khaled Annis
*Assistant Examiner* — Dakota Marin
(74) *Attorney, Agent, or Firm* — Panitch Schwarze Belisario & Nadel LLP

(57) ABSTRACT

A detachable pad fastening structure of a helmet includes a first fastening unit, which includes a first fastening member having a fastening hole formed therein and is disposed at an inner surface of a helmet main body. A second fastening unit includes a through-hole in the form of a slot in a detachable pad and a second fastening member formed to be movable relative to the through-hole, having at least a part protruding toward the outside of the detachable pad so as to be inserted into the fastening hole when the second fastening member is located at one side of the through-hole, and configured to be (Continued)

inserted toward the inside of the detachable pad so as to be removed from the fastening hole when the second fastening member is moved relative to the through-hole toward the other side of the through-hole.

8 Claims, 17 Drawing Sheets

(52) U.S. Cl.
CPC ..... *A42B 3/122* (2013.01); *A42B 3/124* (2013.01); *A42B 3/125* (2013.01)

(58) Field of Classification Search
USPC ..... 2/414
See application file for complete search history.

(56) References Cited

U.S. PATENT DOCUMENTS

| | | | | |
|---|---|---|---|---|
| 6,185,753 | B1 | 2/2001 | Arai | |
| 6,256,797 | B1 * | 7/2001 | Nemoto | A42B 3/328 2/424 |
| 6,421,841 | B2 * | 7/2002 | Ikeda | A42B 3/127 2/267 |
| 7,854,023 | B2 * | 12/2010 | Ando | A42B 3/127 2/414 |
| 8,239,970 | B2 * | 8/2012 | Ikeda | A42B 3/127 24/114.4 |
| 8,549,671 | B2 * | 10/2013 | Sackett | A42B 3/328 2/414 |
| 8,800,065 | B2 * | 8/2014 | Ikeda | A42B 3/328 2/414 |
| 10,342,282 | B2 * | 7/2019 | Salvetti | A42B 3/328 |
| 2020/0163401 | A1 * | 5/2020 | Lee | A42B 3/328 |

FOREIGN PATENT DOCUMENTS

| | | | | |
|---|---|---|---|---|
| JP | 2007303007 | A | 11/2007 | |
| JP | 2010100955 | A | 5/2010 | |
| KR | 20000005574 | A | 1/2000 | |
| KR | 20090096277 | A | 9/2009 | |
| KR | 200465671 | Y1 | 3/2013 | |
| WO | WO-2019017565 | A1 * | 1/2019 | A42B 3/127 |
| WO | WO-2022190051 | A1 * | 9/2022 | |

OTHER PUBLICATIONS

Search Report dated Jun. 21, 2019 in European Application No. 16870871.7.

* cited by examiner

DETACHABLE PAD FASTENING STRUCTURE OF HELMET AND HELMET INCLUDING SAME

CROSS-REFERENCE TO RELATED APPLICATIONS

This application is a Section 371 of International Application No. PCT/KR2016/002804, filed Mar. 21, 2016, which was published in the Korean language on Jun. 8, 2017, under International Publication No. WO 2017/094974 A1, which claims priority under 35 U.S.C. § 119(b) to Korean Application No. 10-2015-0168948, filed Nov. 30, 2015, the disclosures of which are incorporated herein by reference in their entirety.

TECHNICAL FIELD

The present disclosure relates to a detachable pad fastening structure of a helmet and a helmet including the same, and more particularly, to a detachable pad fastening structure of a helmet capable of facilitating removal of a detachable pad and a helmet including the same.

BACKGROUND ART

Generally, helmets are worn to protect a head of a rider when the rider rides a motorcycle or the like, and it is provided that helmets be worn for safety when driving.

A full face type helmet is being widely used, and such a full face type helmet includes a helmet main body having an inner space and forming an exterior of the helmet, and a liner fixed to an inner surface of the helmet main body and adhered to a head of a wearer, thus serving as a cushion.

The helmet main body has a sufficient strength capable of withstanding an impact applied from the outside without being damaged and thus serves to protect the head of the wearer, and the liner absorbs and mitigates an impact when the impact is applied to the helmet main body and thus serves to promote safety of the wearer.

In addition to the above-described liner, the full face type helmet may further include a detachable pad mounted at the helmet main body for the helmet to fit various sizes of heads of wearers.

Generally, the above-described detachable pad covers a remaining open portion generated at a neck circumference of the wearer in a state in which the wearer is wearing the helmet, and serves to adhere and fix the helmet to the head of the wearer.

However, in a case where an accident or the like occurs, the conventional detachable pad has a problem of causing a serious injury since, in many cases, a fastened state of the detachable pad may not unfasten such that the helmet is unable to be separated from the head of the wearer even in a situation in which the helmet has to be naturally removed from the head of the wearer.

Therefore, a method of solving such problems is required.

DISCLOSURE

Technical Problem

The present disclosure is directed to providing a detachable pad fastening structure of a helmet capable of facilitating removal of a detachable pad from a helmet main body upon occurrence of an accident.

Objects of the present disclosure are not limited to those mentioned above, and other unmentioned objects should be clearly understood by those of ordinary skill in the art from the description below.

Technical Solution

One aspect of the present disclosure provides a detachable pad fastening structure of a helmet, the detachable pad fastening structure including a first fastening unit which includes a first fastening member having a fastening hole formed therein and is disposed at an inner surface of a helmet main body, and a second fastening unit which includes a through-hole formed in the form of a slot in a detachable pad and a second fastening member formed to be movable relative to the through-hole, having at least a part protruding toward the outside of the detachable pad so as to be inserted into the fastening hole in a state in which the second fastening member is located at one side of the through-hole, and configured to be inserted toward the inside of the detachable pad so as to be separated from the fastening hole in a case where the second fastening member is moved relative to the through-hole toward the other side of the through-hole.

The second fastening member may be disposed in a direction opposite the first fastening unit with respect to the through-hole, and may include an insertion part which protrudes to be insertable into the fastening hole in a state in which the second fastening member is located at one side of the through-hole, a deviation preventing part disposed at the direction opposite the insertion part with respect to the through-hole, and a connecting part configured to connect the insertion part and the deviation preventing part.

The second fastening unit may further include a movement guide formed at a circumference of the through-hole and configured to guide movement of the second fastening member relative to the through-hole.

The movement guide may include an inclined part formed to be inclined so that the second fastening member is inserted into the detachable pad when the second fastening member is moved relative to the through-hole from one side to the other side of the through-hole.

The movement guide may further include a first seating part formed at one side of the inclined part to form a preset angle with the inclined part, and configured to fix the second fastening member for at least the part of the second fastening member to maintain a state of protruding toward the outside of the detachable pad.

The movement guide may further include a second seating part formed at the other side of the inclined part to form a preset angle with the inclined part, and configured to fix the second fastening member for the second fastening member to maintain a state of being inserted into the detachable pad.

The number of first fastening units may be n, the number of second fastening units may be n−1, and the detachable pad fastening structure may further include a third fastening unit including a third fastening member coupled to the fastening hole formed in the first fastening member of the first fastening unit that does not correspond to the n−1 second fastening units, and configured to allow the detachable pad to be rotated with respect to the helmet main body in a state in which the n−1 second fastening units are separated from the first fastening unit.

Advantageous Effects

The detachable pad fastening structure of a helmet of the present disclosure for achieving the above-mentioned objects has the following advantageous effects.

First, in a case where an accident or the like occurs, there is an advantage of allowing a detachable pad to be naturally separated from a helmet main body in a situation in which the helmet main body has to be removed from a head of a wearer, thereby minimizing injury to the wearer.

Second, since a fastening mechanism is simple, there is an advantage in that fastening between the detachable pad and the helmet main body can be easily performed.

Advantageous effects of the present disclosure are not limited to the above-mentioned advantageous effects, and other unmentioned advantageous effects should be clearly understood by those of ordinary skill in the art from the claims below.

MODES OF THE INVENTION

Figure 1:
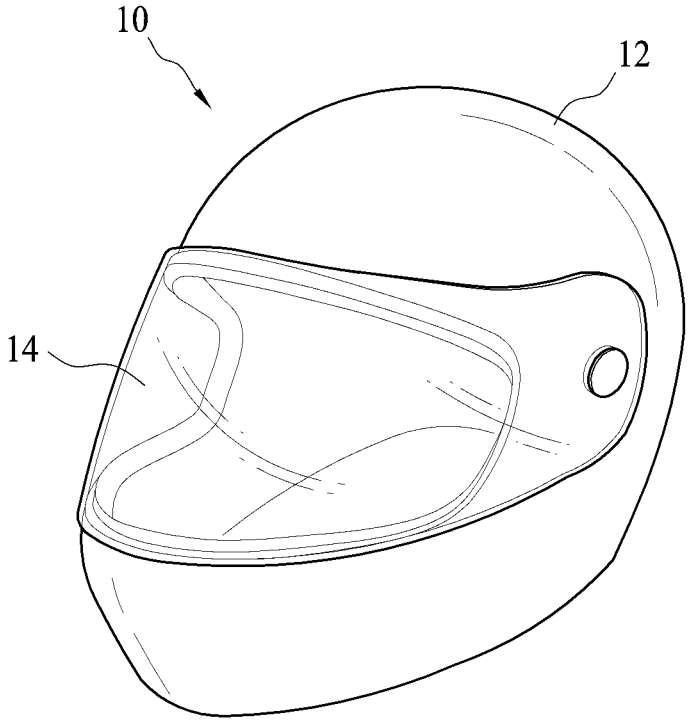
FIGS. 1 and 2 are views illustrating a state of a helmet main body to which a detachable pad fastening structure of a helmet according to a first embodiment of the present disclosure is applied.

Hereinafter, exemplary embodiments of the present disclosure through which the objects of the present disclosure can be specifically realized will be described with reference to the accompanying drawings. In describing the present embodiment, the same names and the same reference numerals will be used for the same elements, and additional description according thereto will be omitted.

Figure 2:
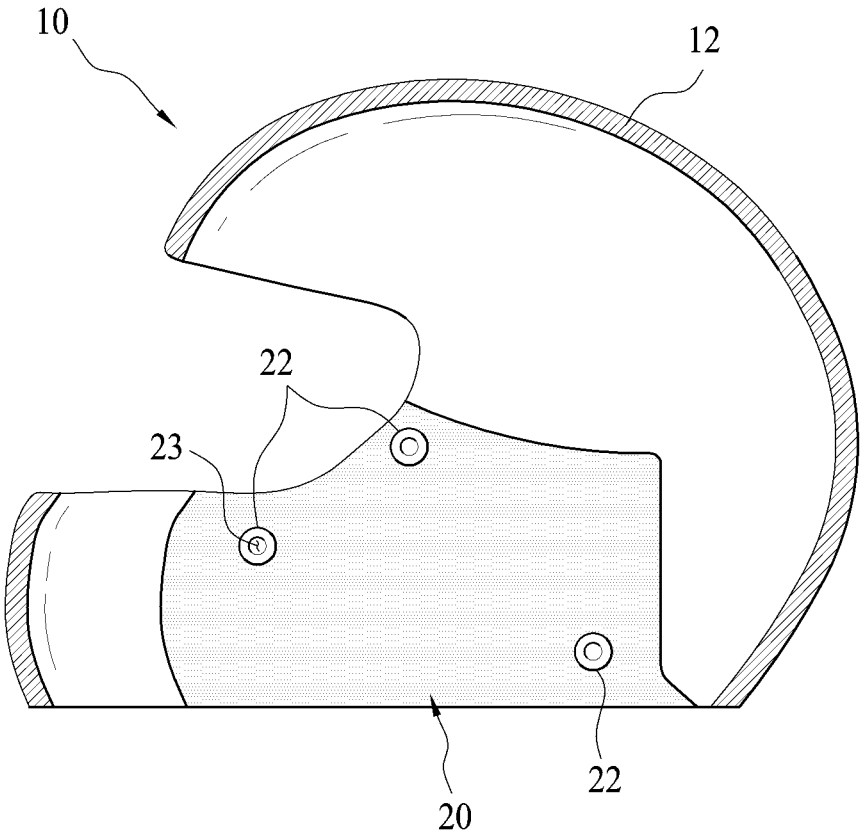
Figure 3:
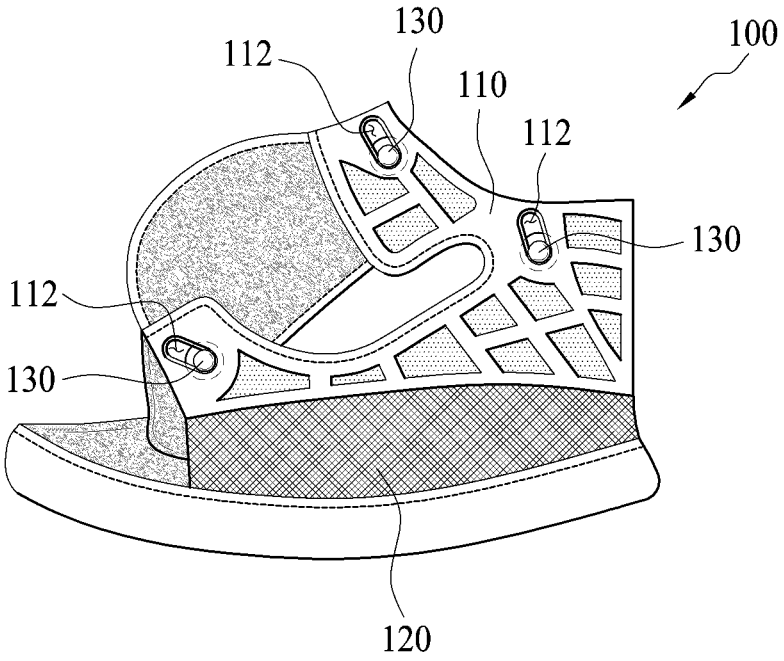
FIG. 3 is a view illustrating a state of a detachable pad to which the detachable pad fastening structure of the helmet according to the first embodiment of the present disclosure is applied.

FIGS. 1 and 2 are views illustrating a state of a helmet main body 12 to which a detachable pad fastening structure of a helmet according to a first embodiment of the present disclosure is applied, and FIG. 3 is a view illustrating a state of a detachable pad 100 to which the detachable pad fastening structure of the helmet according to the first embodiment of the present disclosure is applied.

Figure 4:
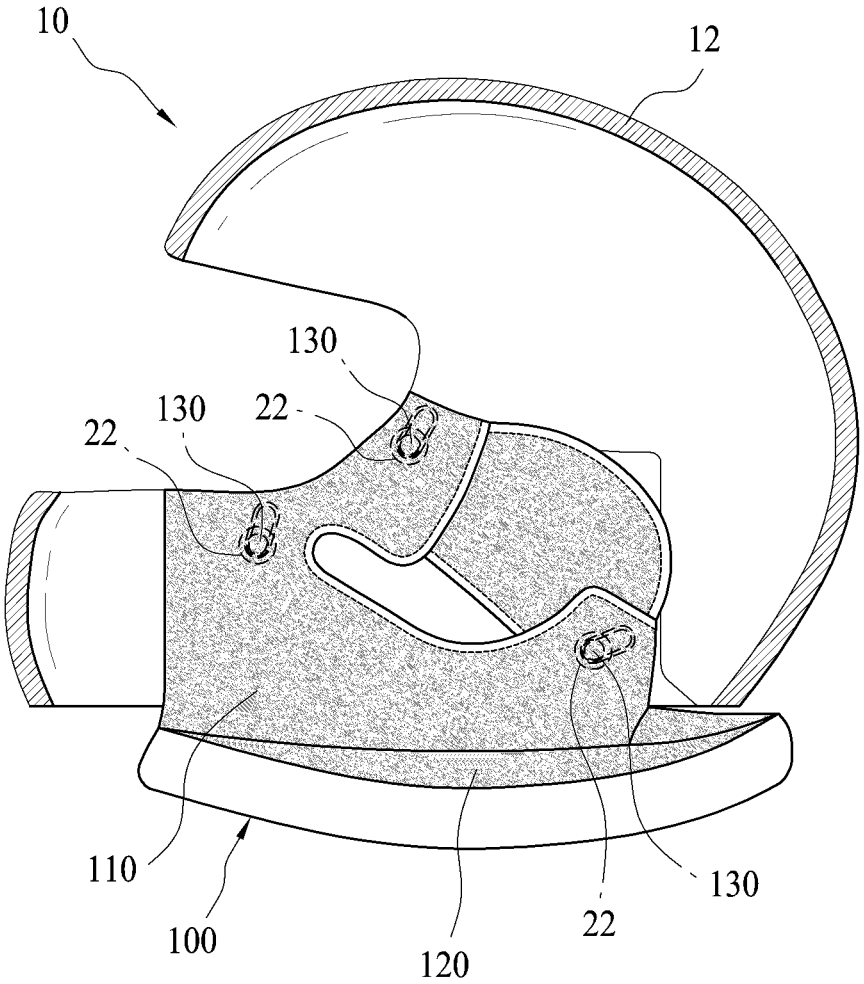
FIG. 4 is a view illustrating a state in which the helmet main body and the detachable pad are coupled by the detachable pad fastening structure of the helmet according to the first embodiment of the present disclosure.

FIG. 4 is a view illustrating a state in which the helmet main body 12 and the detachable pad 100 are coupled by the detachable pad fastening structure of the helmet according to the first embodiment of the present disclosure.

As illustrated in FIGS. 1 to 4, a helmet 10 according to the present disclosure includes the helmet main body 12 and the detachable pad 100.

In the present embodiment, a transparent part 14 for securing visibility of a wearer is disposed at a front surface of the helmet main body 12, and the detachable pad 100 has a fitting part 120 coming into contact with chin and neck portions of the wearer to fit the size, and a second coupling part 110 corresponding to a first coupling part 20 of the helmet main body 12.

In this case, a first fastening unit and a second fastening unit for coupling between the helmet main body 12 and the detachable pad 100 are formed at the first coupling part 20 and the second coupling part 110. Hereinafter, the first fastening unit and the second fastening unit will be described in detail.

The first fastening unit is formed at the first coupling part 20 formed at both sides of an inner surface of the helmet main body 12, and includes a first fastening member 22 having a fastening hole 23 formed therein. In the case of the present embodiment, a plurality of first fastening members 22 are disposed to be spaced apart from each other in the first coupling part 20.

The second fastening unit includes a through-hole 112 formed in the second coupling part 110 of the detachable pad 100, and a second fastening member 130 inserted by passing through the through-hole 112. In the present embodiment, like the first fastening member 22, a plurality of through-holes 112 and a plurality of second fastening members 130 are formed in the second coupling part 110, and each of the plurality of through-holes 112 and the plurality of second fastening members 130 corresponds to one of the plurality of first fastening members 22.

Particularly, the through-hole 112 may be formed in the form of a slot in the second coupling part 110 of the detachable pad 100, and the second fastening member 130 may be moved relative to the through-hole 112 in a longitudinal direction of the through-hole 112 within the through-hole 112. That is, in a case where the detachable pad 100 is moved downward in a state in which the detachable pad 100 is coupled to the helmet main body 12, the through-hole 112 is moved along with the detachable pad 100, and accordingly, the second fastening member 130 may be moved relative to the through-hole 112 toward the other side of the through-hole 112 and located at the other side of the through-hole 112.

The second fastening member 130 has at least a part protruding toward the outside of the detachable pad 100 in a state in which the second fastening member 130 is located at one side of the through-hole 112, and is inserted toward the inside of the detachable pad 100 in a case where the second fastening member 130 is moved relative to the through-hole 112 toward the other side of the through-hole 112.

Accordingly, the second fastening member 130 is inserted into the fastening hole 23 of the first fastening member 22 in the state in which the second fastening member 130 is located at one side of the through-hole 112, thus coupling the helmet main body 12 and the detachable pad 100, and in a state in which the second fastening member 130 is moved relative to the through-hole 112 toward the other side of the through-hole 112, the second fastening member 130 is separated from the fastening hole 23, thus separating the detachable pad 100 from the helmet main body 12.

Hereinafter, such a coupling structure will be described in more detail.

Figure 5:
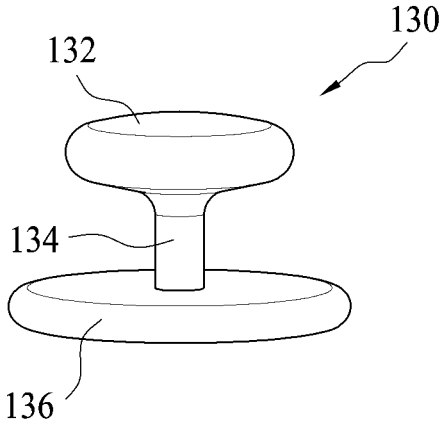
FIGS. 5 to 8 are views illustrating a structure of a second fastening unit in the detachable pad fastening structure of the helmet according to the first embodiment of the present disclosure.
Figure 6:
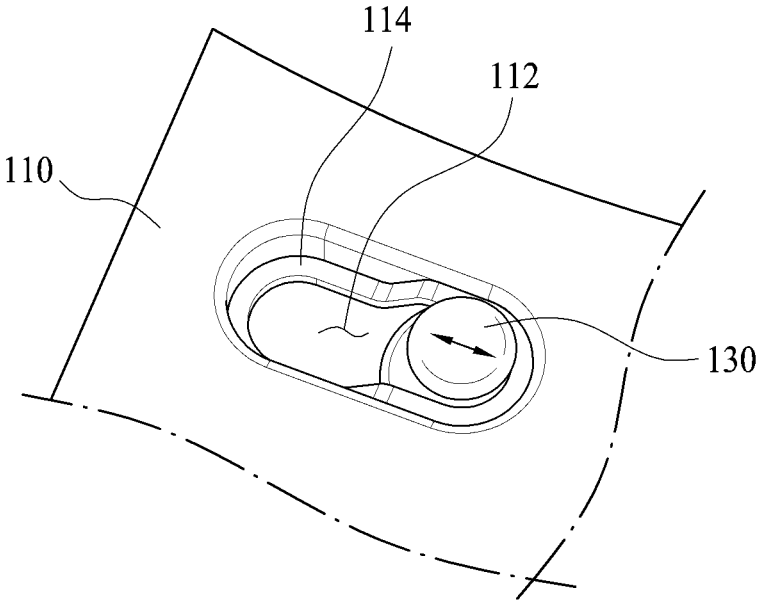

As illustrated in FIG. 5, in the present embodiment, the second fastening member 130 includes an insertion part 132, a connecting part 134, and a deviation preventing part 136. As illustrated in FIG. 6, the second fastening member 130 is inserted into the through-hole 112, and in this case, a movement guide 114 configured to guide movement of the second fastening member 130 relative to the through-hole 112 is formed at a circumference of the through-hole 112.

The insertion part 132 is disposed in a direction facing the first fastening unit of the helmet main body 12, i.e., the inner surface of the helmet main body 12, with respect to the through-hole 112. The deviation preventing part 136 is disposed in a direction opposite the insertion part 132 with respect to the through-hole 112, and the connecting part 134 is disposed in the form of connecting the insertion part 132 and the deviation preventing part 136.

In this case, in the present embodiment, the insertion part 132 and the deviation preventing part 136 are formed to have a width wider than that of the through-hole 112, the connecting part 134 is formed to have a width narrower than that of the through-hole 112, and the second fastening member 130 maintains a state in which the connecting part 134 is inserted into the through-hole 112 and locked.

Figure 7:
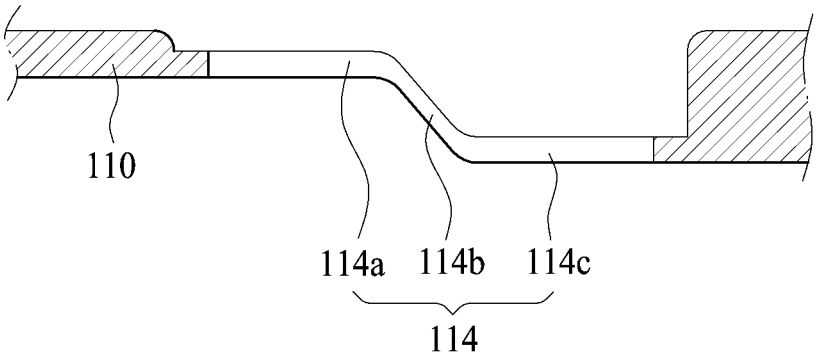

In the case of the present embodiment, as illustrated in FIG. 7, the movement guide 114 includes a first seating part 114*a*, an inclined part 114*b*, and a second seating part 114*c*.

The inclined part 114*b* is formed to be inclined so that the second fastening member 130 is inserted into the inside of the detachable pad when the second fastening member 130 is moved relative to the through-hole 112 from one side to the other side of the through-hole 112.

In this case, the first seating part 114*a* is formed at one side of the inclined part 114*b* to form a preset angle with the inclined part 114*b*, and the second seating part 114*c* is formed at the other side of the inclined part 114*b* to form a preset angle with the inclined part 114*b*.

That is, the first seating part 114*a* and the second seating part 114*c* have relative positions different from each other to have a step, and the inclined part 114*b* serves to change the relative positions therebetween.

Figure 8:
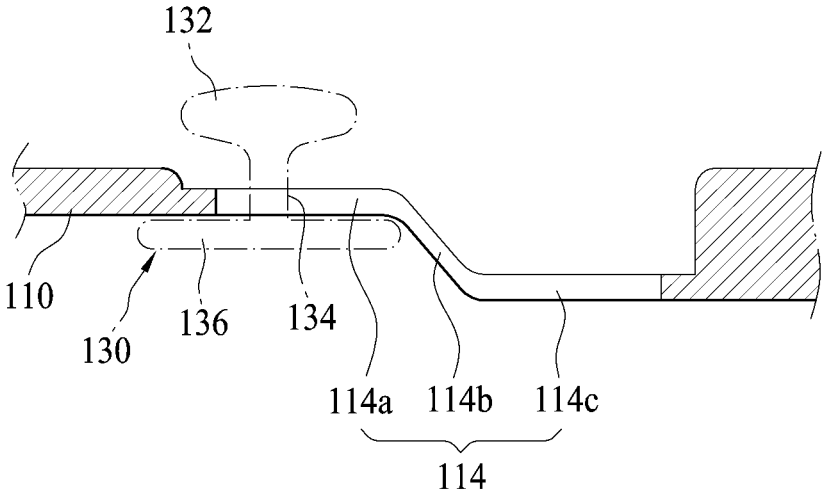
Figure 9:
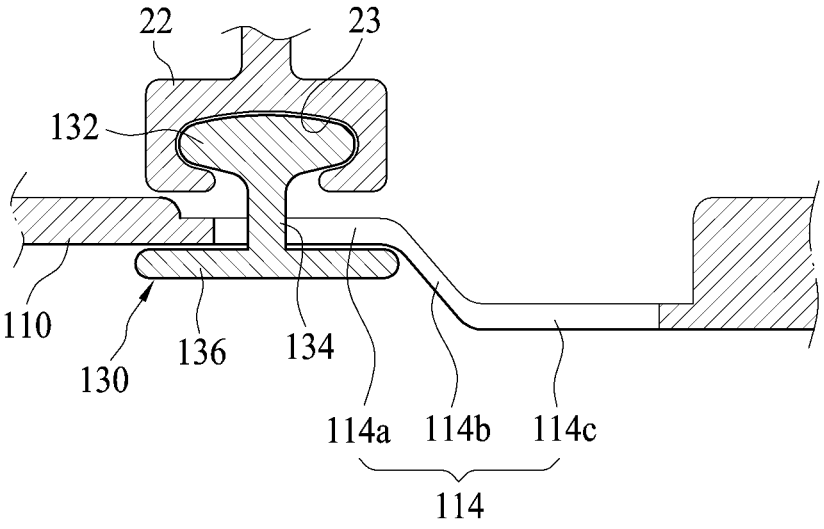
FIGS. 9 to 13 are views illustrating a process in which a first fastening unit and the second fastening unit are separated from each other in the detachable pad fastening structure of the helmet according to the first embodiment of the present disclosure.

Particularly, as illustrated in FIG. 8, the second fastening member 130 maintains a state in which the insertion part 132 protrudes toward the outside of the detachable pad 100 in a state in which the second fastening member 130 is located at one side of the through-hole 112, that is, the first seating part 114*a* of the movement guide 114, and accordingly, as illustrated in FIG. 9, the second fastening member 130 may be inserted into the fastening hole 23 of the first fastening member 22.

Therefore, the helmet main body 12 and the detachable pad 100 are in a state of being coupled by the first fastening member 22 and the second fastening member 130.

Figure 10:
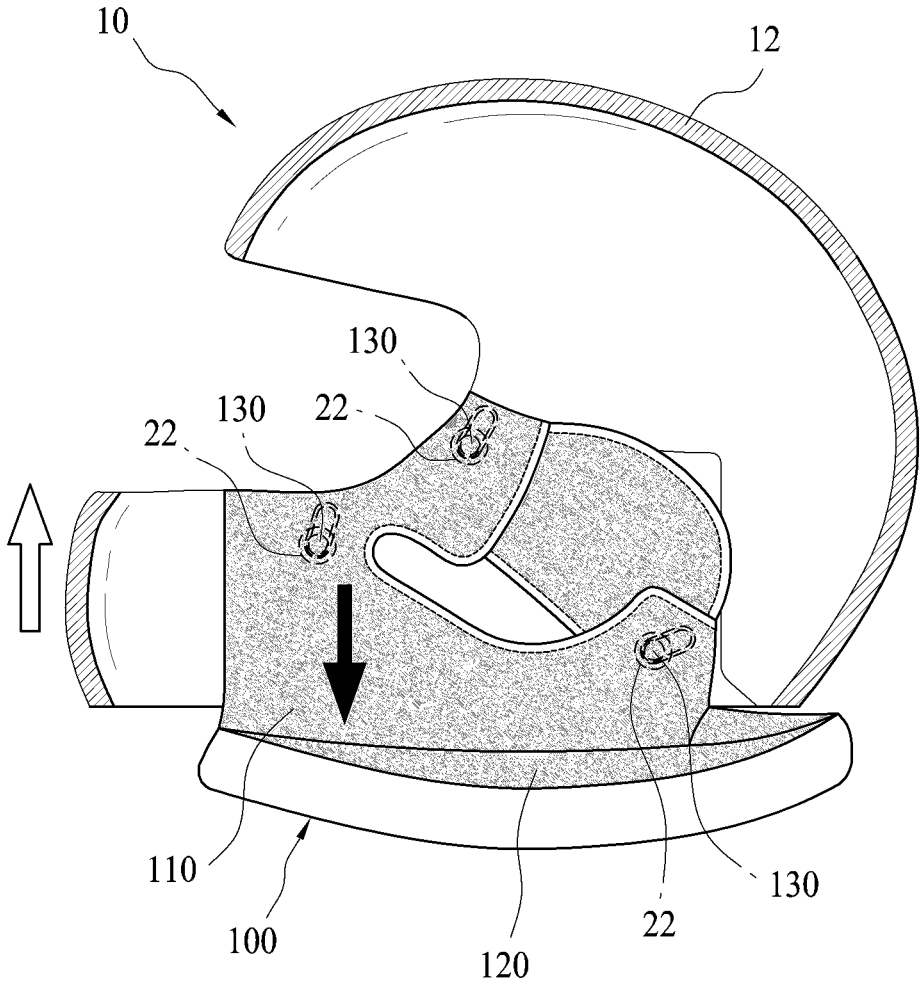
Figure 11:
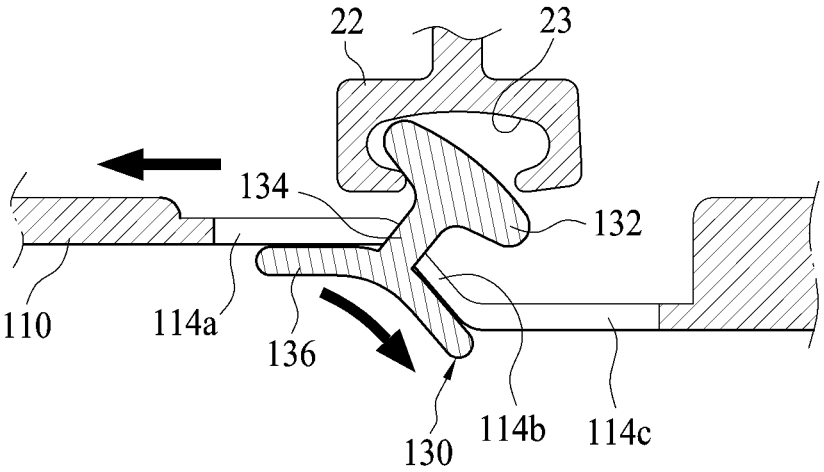
Figure 12:
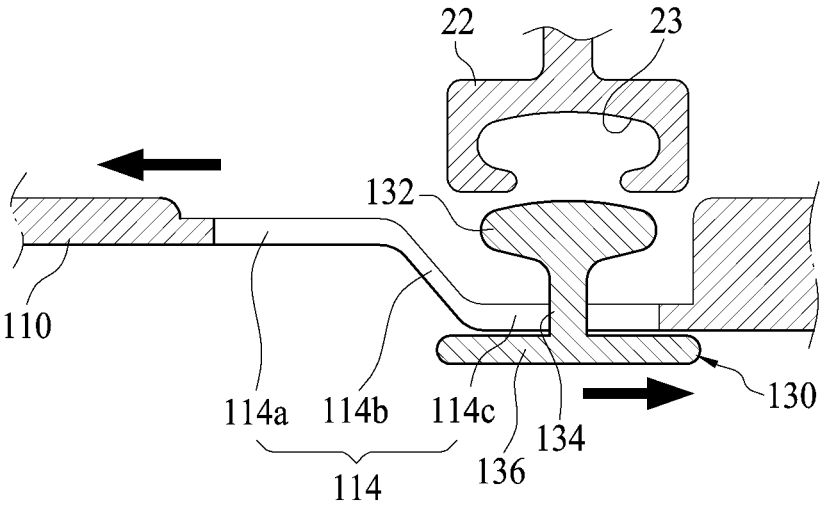

In such a state, in a case where the helmet main body 12 and the detachable pad 100 are moved in directions opposite from each other as illustrated in FIG. 10, the second fastening member 130 is moved relative to the through-hole 112 toward the other side of the through-hole 112 in a state in which the second fastening member 130 is coupled to the first fastening member 22 in accordance with movement of the detachable pad 100 as illustrated in FIGS. 11 and 12.

In this process, the second fastening member 130 passes through the inclined part 114*b* of the movement guide 114, and since the deviation preventing part 136 of the second fastening member 130 has a width wider than that of the through-hole 112 as described above, the deviation preventing part 136 is moved relative to the inclined part 114*b* of the movement guide 114 along the inclined part 114*b*.

Accordingly, the entire second fastening member 130 is moved relative to the inclined part 114*b* toward the second seating part 114*c* along the inclined part 114*b* so as to be inserted into the inside of the detachable pad 100, and the second fastening member 130 is forcibly removed from the fastening hole 23 of the first fastening member 22.

Figure 13:
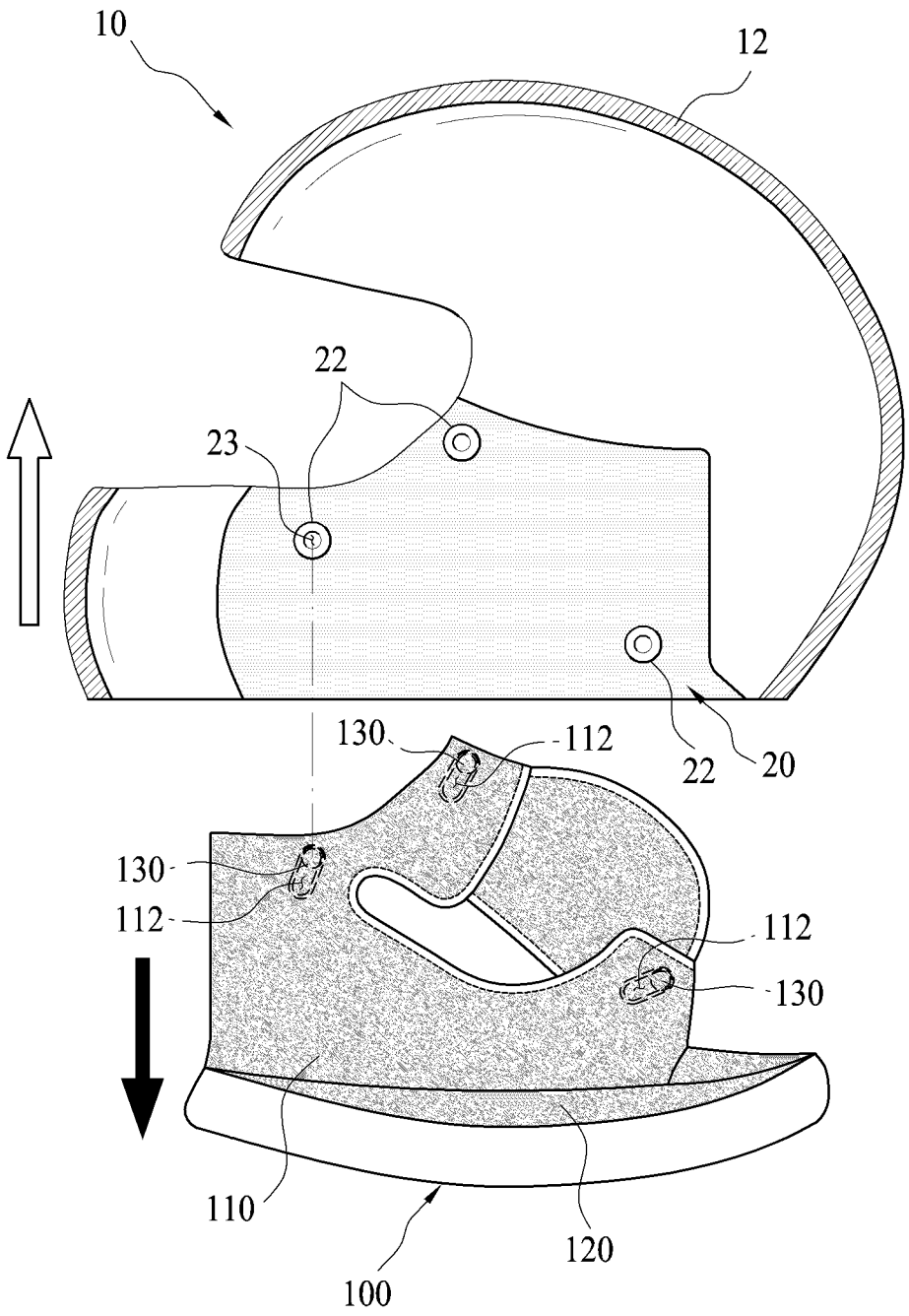

As a result, as illustrated in FIG. 13, in a case where the helmet main body 10 and the detachable pad 110 are moved relative to each other in opposite directions, fastening between the first fastening member 22 and the second fastening member 130 may be released by the above-described process, and the helmet main body 10 and the detachable pad 110 may be completely separated from each other.

That is, in the present disclosure, the first fastening member 22 and the second fastening member 130 may be separated from each other just by moving the helmet main body 10 and the detachable pad 110 relative to each other in opposite directions, and separate effort is not required.

In the present embodiment, the first seating part 114*a* and the inclined part 114*b* and the inclined part 114*b* and the second seating part 114*c* are formed to have linear cross-sections and are formed to have predetermined angles therebetween. The reason for forming of the linear cross-sections and predetermined angles is to form a resistance spot for each section in the process in which the second fastening member 130 is moved relative to the through-hole 122 within the through-hole 122. That is, by ensuring that a predetermined load is applied in the process in which the second fastening member 130 performs relative movement between the first seating part 114*a*, the inclined part 114*b*, and the second seating part 114*c* of the movement guide 114, the first fastening member 22 and the second fastening member 130 may be prevented from being separated from each other due to an external force smaller than or equal to a reference external force.

The first embodiment of the present disclosure has been described above, and other embodiments of the present disclosure will be described below.

Figure 14:
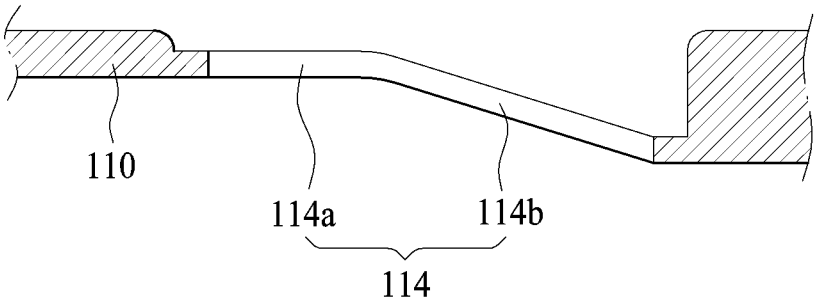
FIG. 14 is a view illustrating a structure of a movement guide of a second fastening unit in a detachable pad fastening structure of a helmet according to a second embodiment of the present disclosure.

FIG. 14 is a view illustrating a structure of a movement guide 114 of a second fastening unit in a detachable pad fastening structure of a helmet according to a second embodiment of the present disclosure.

In the case of the second embodiment of the present disclosure illustrated in FIG. 14, the movement guide 114 has the form in which only a first seating part 114*a* and an inclined part 114*b* are included, and the second seating part 114*c* in the first embodiment is omitted. Even in this case, the same advantageous effect as that of the first embodiment may be obtained.

Further, the movement guide 114 may also be formed only with the inclined part 114*b* without the first seating part 114*a*.

Figure 15:
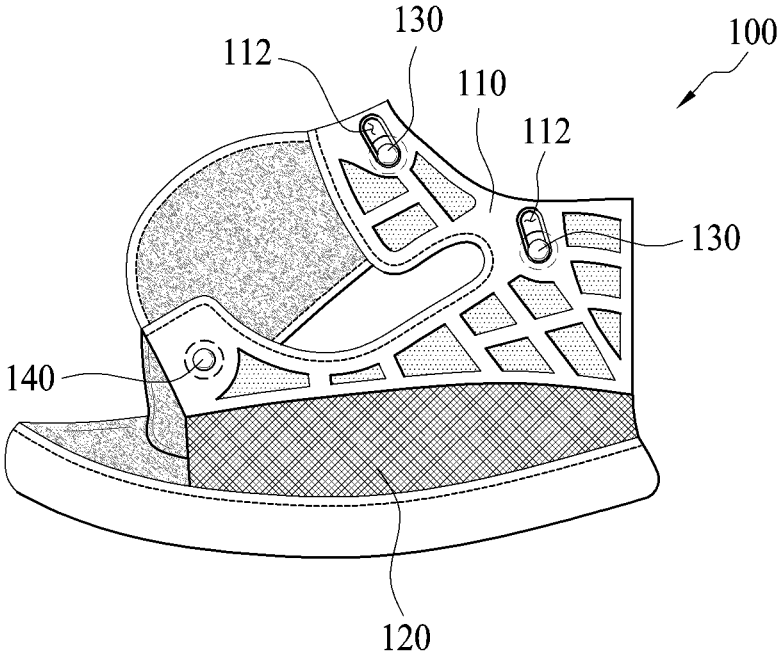
FIGS. 15 and 16 are views illustrating a detachable pad fastening structure of a helmet according to a third embodiment of the present disclosure.
Figure 16:
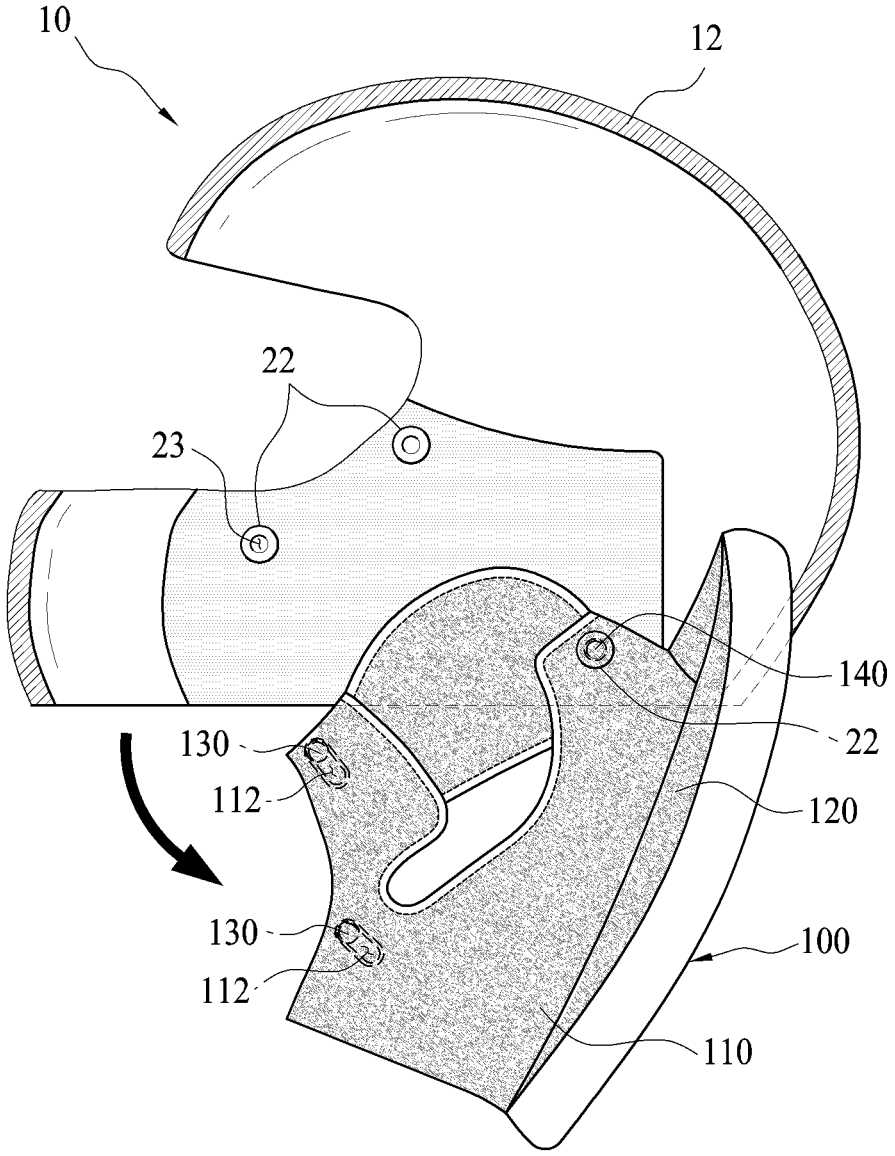

FIGS. 15 and 16 are views illustrating a detachable pad fastening structure of a helmet according to a third embodiment of the present disclosure.

The third embodiment of the present disclosure illustrated in FIGS. 15 and 16 is different from the above-described embodiments in that any one of the second fastening units disposed in the detachable pad 100 is substituted with a third fastening unit.

That is, in the present embodiment, in a case where the number of first fastening units is n, the number of second fastening units is n−1, and a third fastening member 140 of a third fastening unit is coupled to first fastening member 22 of the remaining first fastening unit that does not correspond to the n−1 second fastening units. Unlike the second fastening unit, a through-hole is not formed in the form of a slot in the third fastening unit, and therefore, unlike the second fastening member 130, the third fastening member 140 is formed so as not to be moved relative to the detachable pad 110.

Accordingly, in the present embodiment, in a case where the helmet main body 10 and the detachable pad 110 are moved relative to each other in opposite directions, only the second fastening member 130 is removed and separated from the first fastening member 22, and the third fastening member 140 maintains a state of being coupled to the corresponding first fastening member 22 such that the detachable pad 100 is rotated with respect to the helmet main body 12 about the third fastening member 140.

Although any one of the second fastening units is substituted with the third fastening unit in the present embodiment, since a lower opening of the helmet main body 12 is open by rotation of the detachable pad 100 as in the other embodiments described above, the helmet main body 12 may be smoothly removed from a head of a wearer.

Figure 17:
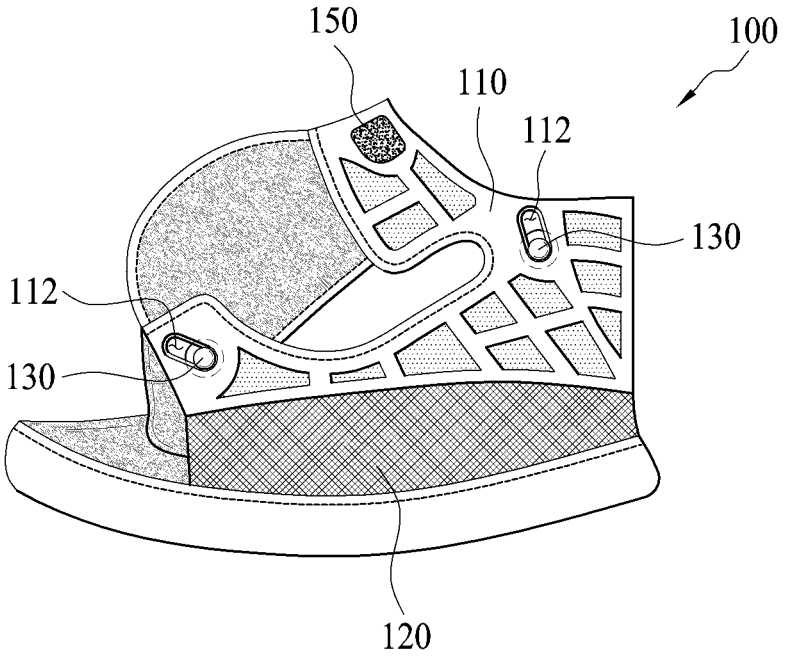
FIG. 17 is a view illustrating a detachable pad fastening structure of a helmet according to a fourth embodiment of the present disclosure.

FIG. 17 is a view illustrating a detachable pad fastening structure of a helmet according to a fourth embodiment of the present disclosure.

The fourth embodiment of the present disclosure illustrated in FIG. 17 is different from the above-described embodiments in that a second fastening unit located at an upper central portion from among the second fastening units disposed in the detachable pad 100 is substituted with a fourth fastening unit.

In the present embodiment, unlike the second fastening unit in the above-described first embodiment or second embodiment, the fourth fastening unit is formed in the form of Velcro 150. Accordingly, a fastening unit in the form corresponding to the Velcro 150 may be disposed at the helmet main body side.

The reason for substituting the second fastening unit located at the upper central portion from among the second fastening units with the fourth fastening unit as above in the present embodiment is to minimize a foreign body sensation of a wearer. That is, the upper central portion of the detachable pad 100 is a point at which a cheek portion of the wearer is adhered, and in a case where the second fastening unit is disposed at the point, there is a problem in that the user's skin may be pressed by the protruding second fastening member 130. Therefore, in the present embodiment, the second fastening unit at the upper central portion of the detachable pad 100 is substituted with the fourth fastening unit in the form of Velcro 150 to minimize discomfort of the wearer.

Exemplary embodiments according to the present disclosure have been described above, and it is self-evident to those of ordinary skill in the art that, in addition to the above-described embodiments, the present disclosure may be embodied in other specific forms without departing from the gist or scope thereof. Thus, the above-described embodiments should be considered as illustrative instead of limitative, and accordingly, the present disclosure is not limited to the above description and may be modified within the scope of the attached claims and their equivalents.

The invention claimed is:

1. A detachable pad fastening structure of a helmet, the detachable pad fastening structure comprising:

a first fastening unit which includes a first fastening member having a fastening hole formed therein and is disposed at an inner surface of a helmet main body; and a second fastening unit which includes a through-hole in a detachable pad, the through-hole having a shape of an elongated slot with a first longitudinal side spaced apart from and parallel to a second longitudinal side and one end spaced from an other end, and a second fastening member insertable in and movable relative to the through-hole when inserted therein, the second fastening member having at least a portion protruding toward an outside of the detachable pad and insertable into the fastening hole in a state in which the second fastening member is located at the one end of the through-hole, and inserted toward an inside of the detachable pad so as to be separated from the fastening hole in a case where the second fastening member is moved relative to the through-hole toward the other end of the through-hole, wherein the second fastening member is disposed in a direction opposite the first fastening unit with respect to the through-hole, and includes:

an insertion part which protrudes to be insertable into the fastening hole in a state in which the second fastening member is located at one side of the through-hole;

a deviation preventing part disposed at a direction opposite the insertion part with respect to the through-hole; and a connecting part configured to connect the insertion part and the deviation preventing part;

wherein a width of the insertion part is wider than a width of the through-hole, a width of the deviation preventing part is wider than the width of the through-hole, and the connecting part of the second fastening member is narrower than the width of the through-hole, such that the second fastening member with the connecting part within the through-hole is movably secured within the through-hole;

wherein the second fastening unit further includes a movement guide formed at a circumference of the through-hole and configured to guide movement of the second fastening member relative to the through-hole;

wherein the movement guide includes an inclined part formed to be inclined so that the second fastening member is inserted into the detachable pad upon the second fastening member being moved relative to the through-hole from the one end to the other end of the through-hole;

wherein the movement guide further includes a first seating part formed at one side of the inclined part and a second seating part formed at the other side of the inclined part, and the first seating part is disposed relatively outwardly with respect to the detachable pad as compared to the second seating part, and the second seating part is disclosed relatively inwardly with respect to the detachable pad as compared to the first seating part; and wherein when the first fastening member and the second fastening member are at the first seating part, the first fastening member and the second fastening member are joined; and when the first fastening member and the second fastening member are moved from the first seating part to the second seating part, the inclined part causes the second fastening member to move inwardly with respect to the detachable pad so that the first fastening member and the second fastening member are separated.

2. The detachable pad fastening structure of claim 1, wherein the first seating part forms a preset angle with the inclined part, and the first seating part is configured to fix the second fastening member for at least a part of the second fastening member to maintain a state of protruding toward the outside of the detachable pad.

3. The detachable pad fastening structure of claim 1, wherein the second seating part forms a preset angle with the inclined part, and the second seating part is configured to fix the second fastening member for the second fastening member to maintain a state of being inserted into the detachable pad.

4. The detachable pad fastening structure of claim 1, wherein:

the number of first fastening units is n, and the number of second fastening units is n−1; and the detachable pad fastening structure further includes a third fastening unit including a third fastening member coupled to a fastening hole formed in a first fastening member of a first fastening unit that does not correspond to the n−1 second fastening units, and configured to allow the detachable pad to be rotated with respect to the helmet main body in a state in which the n−1 second fastening units are separated from the first fastening unit.

5. A helmet comprising the detachable pad fastening structure of claim 1.

6. A helmet comprising the detachable pad fastening structure of claim 2.

7. A helmet comprising the detachable pad fastening structure of claim 3.

8. A helmet comprising the detachable pad fastening structure of claim 4.

* * * * *